US009140106B2

(12) United States Patent
Rexilius et al.

(10) Patent No.: US 9,140,106 B2
(45) Date of Patent: Sep. 22, 2015

(54) SYSTEM AND METHOD FOR PRODUCING HYDROCARBONS FROM A WELL

(75) Inventors: Jarrad Rexilius, North Fremantle (AU); Tipparat Wamanon, Bangkok (TH); Akshay Sahni, Bakersfield, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 630 days.

(21) Appl. No.: 13/169,545

(22) Filed: Jun. 27, 2011

(65) Prior Publication Data

US 2012/0000668 A1 Jan. 5, 2012

Related U.S. Application Data

(60) Provisional application No. 61/360,235, filed on Jun. 30, 2010.

(51) Int. Cl.
*E21B 43/12* (2006.01)
*E21B 43/36* (2006.01)

(52) U.S. Cl.
CPC ..... *E21B 43/121* (2013.01); *E21B 43/122* (2013.01); *E21B 43/36* (2013.01)

(58) Field of Classification Search
USPC ..... 166/267, 372, 357
See application file for complete search history.

(56) References Cited

U.S. PATENT DOCUMENTS 2,034,798 A * 3/1936 Clark ..... 166/370
4,697,426 A * 10/1987 Knowles, Jr. ..... 62/46.1
4,711,306 A * 12/1987 Bobo ..... 166/372
6,283,204 B1 9/2001 Brady et al.
6,640,901 B1 * 11/2003 Appleford et al. ..... 166/357
6,691,781 B2 2/2004 Grant et al.
7,607,479 B2 * 10/2009 Cognata ..... 166/265
8,286,257 B2 * 10/2012 Carney ..... 726/28
2005/0072574 A1 * 4/2005 Appleford et al. ..... 166/366
2006/0054318 A1 3/2006 Sarada
2006/0196674 A1 9/2006 Butler et al.
2011/0083855 A1 * 4/2011 Wygnanski ..... 166/372
2012/0152532 A1 * 6/2012 Senties ..... 166/250.15

OTHER PUBLICATIONS

PCT Search Report and Written Opinion, PCT/US2011/041965 mailed Nov. 29, 2011.

* cited by examiner

*Primary Examiner* — Giovanna C Wright
(74) *Attorney, Agent, or Firm* — A. Stephen Zavell

(57) ABSTRACT

A system for producing hydrocarbons from a well includes an unloading unit that receives fluids from a wellhead. The unloading unit separates the oil and gas, and the oil is pumped to a pipeline. Using the unloading unit and the pump helps to reduce the pressure at the wellhead which helps increase production. The gas separated by the unloading unit is compressed and re-injected into the well to create a gas lift which further helps increase production. Capturing and reinjecting the separated gas for gas lift operations reduces environmental damages associated with conventional unloading unit and pump assemblies. The unloading unit, compressor, and pump are modular for quicker installation and a smaller footprint. After increasing the productive life of a first reservoir, the system can be broken down and reassembled for use at another reservoir.

2 Claims, 3 Drawing Sheets

SYSTEM AND METHOD FOR PRODUCING HYDROCARBONS FROM A WELL

RELATED APPLICATIONS

This application is related to and claims priority to U.S. provisional application No. 61/360,235 filed on Jun. 30, 2010.

FIELD OF THE INVENTION

The present invention is generally related to hydrocarbon production, and more particularly, to producing hydrocarbons with the assistance of artificial lift.

BACKGROUND OF THE INVENTION

Two forms of artificial lift that help prolong the life of hydrocarbon wells are the use of gas lift and well unloading units. These two forms of artificial lift are common knowledge in the industry and are applied around the world. Moreover, each have inherent challenges, particularly in offshore environments where cost and space become important limitations.

As reservoir pressure declines due to depletion, the lift performance of oil wells suffers and at a certain point the well is no longer able to produce liquids to the surface naturally or economically because the pressure at the reservoir is not large enough to overcome the hydrostatic head of the fluids between it and the production tree at the platform. To increase the hydrocarbon production, the lift performance or inflow performance must be enhanced. If the inflow performance cannot be changed, which is typically the case, then the vertical lift performance must be improved to allow the well to flow. Two effective ways to do this are to reduce the wellhead flowing pressure at the surface or to reduce the hydrostatic head of fluid in the production tubing. Reducing the pressure at the surface can be achieved by using a Well Unloading Unit (WUU). This involves the use of pumping equipment on the surface to reduce backpressure of the well thus allowing flow up the well to surface. The fluids are subsequently pumped into the production pipeline at higher pressure. The problem associated with the conventional well unloading unit process is that any gas produced is vented to the atmosphere and lost. This is both an environmental concern and a lost production/revenue opportunity as the gas has value and could be sold.

Gas lift is another widely used and effective form of artificial lift applied in the industry. Gas lift involves the process of injecting gas at high pressure into the annulus of a well, typically an annulus between the production tubing and the innermost well casing. The gas enters the production tubing several thousand feet below the surface through a check valve and has the desired effect of reducing the fluid gradient in the tubing and thus lowering the wellbore flowing pressure. This increases the drawdown on the well and increases both liquid rates and reserves.

The major problem with applying gas lift to a well is that high pressure gas is required, typically greater than 1000 psi. This gas source can come from other high pressure gas wells being produced on the platform or by installing a compressor to take low pressure gas, compress it, and use it for gas lifting.

Oftentimes, using high pressure gas from other wells is not an option for operations. Additionally, even if there is a well with high pressure gas, it is only a short-term solution as reservoir pressures decline quickly and the gas pressure soon reaches a point where it is not adequate for gas lifting. The other option is to install a gas lift compressor. This is preferred as the pressure can be regulated and a stable supply of gas can be achieved. However, the problem with this option is the high cost, large footprint and immobility of compressors. A gas lift compressor typically requires an investment of more than US$ 2 million. Additionally, the units are immobile—the cost to move a gas lift compressor from one platform to another is more expensive than the compressor itself. A gas lift compressor also has a large foot print and takes up a big portion of the deck space on an offshore platform. If a platform does not warrant the installation of a gas lift compressor due to economics or spacial limitations, then hydrocarbons are typically left behind in the reservoir.

SUMMARY OF THE INVENTION

The present invention provides a well unloading unit and compressor system and an associated method for producing hydrocarbons from a well in fluid communication with a reservoir formation. According to one embodiment, the system includes an unloading unit that is configured to receive a produced fluid having hydrocarbons from the well via a production tree and separate the produced fluid into a liquid fluid and a gas fluid. For example, the unloading unit can be a three-phase separator configured to separate water from the produced fluid, and/or the unloading unit can include a kinetic separator such as a gas-liquid cylindrical cyclone. A compressor in fluid communication with the unloading unit is configured to receive the gas fluid from the unloading unit and compress the gas fluid to a predetermined pressure so that the gas fluid can be re-injected into the well to help lift the produced fluid from the reservoir formation to the production tree. A gas manifold is configured to receive the compressed gas fluid from the compressor and distribute the gas fluid to at least one production tree and at least one corresponding well. A pump is configured to receive the liquid fluids from the unloading unit, increase the fluid pressure of the liquid fluid, and deliver the liquid fluid to a pipeline. For example, the pump, which can be located at an off-shore topside facility, can be configured to deliver the liquid fluid to a subsea pipeline located on a seafloor so that the liquid fluid can be transported through the pipeline to a remote location, such as an on-shore processing facility.

The unloading unit, compressor, and gas manifold can be configured to operate as a substantially closed gas lift system, such that the unloading unit receives the gas fluid previously injected into the well.

In some cases, the system can be provided as a modular system that can be relocated depending on the needs of the reservoir. In particular, the unloading unit, compressor, gas manifold, and pump can be disposed on one or more skids, so that each skid can easily be transported and re-used for producing hydrocarbons from different reservoir formations.

According to another embodiment, a method includes receiving in an unloading unit a produced fluid from the well and separating the produced fluid into a liquid fluid and a gas fluid. For example, the produced fluid can be separated kinetically, such as by a gas-liquid cylindrical cyclone, and/or water can be separated from the gas and liquid fluids. The gas fluid from the unloading unit is compressed to a predetermined pressure and distributed to at least one production tree and corresponding well. From the manifold, the gas fluid is re-injected into the well to help lift the produced fluid from the reservoir. Also, the fluid pressure of the liquid fluid is increased in a pump, and the liquid fluid is delivered to a pipeline, such as a subsea pipeline located on a seafloor. The effect of receiving the produced fluid and increasing the pressure of the liquid fluid can be to reduce the backpressure at the well.

The unloading unit, a compressor for performing the compressing step, a gas manifold for performing the distributing step, and the pump can be provided on one or more skids. Each skid can be transported from a location proximate the reservoir formation to a location proximate a second reservoir formation, and the unloading unit, the compressor, the gas manifold, and the pump can then be re-used for producing hydrocarbons from the second reservoir formation.

In some cases, the step of re-injecting the gas fluid is performed while the unloading unit is receiving the produced fluid from the well, such that the well is producing while being subjected to a gas lift operation. The step of receiving the produced fluid can include receiving gas fluid that was previously injected into the well such that the gas fluid is re-used in a substantially closed gas lift cycle.

DETAILED DESCRIPTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
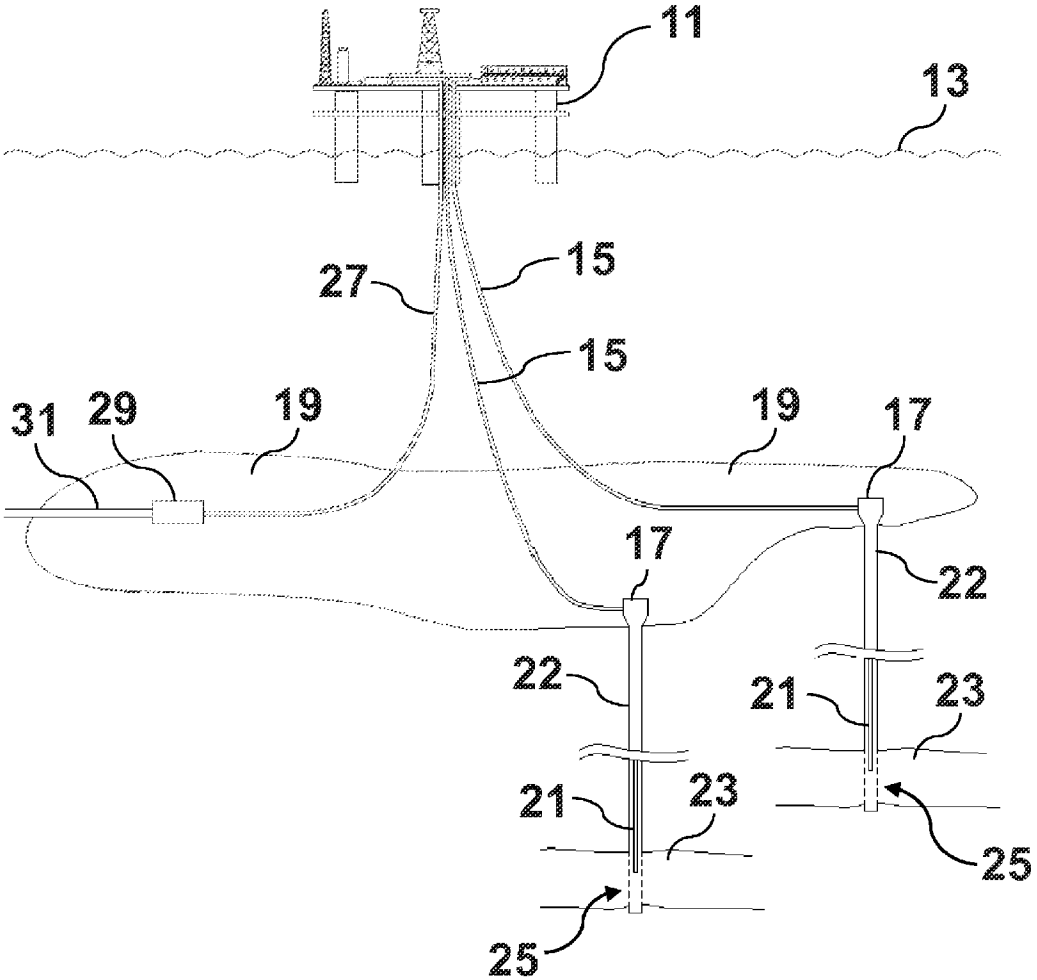
FIG. 1 is an environmental view of an offshore production platform receiving hydrocarbons from a plurality of subsea wells and delivering hydrocarbons to a pipeline, in accordance with an embodiment of the present invention.

Referring to FIG. 1, an offshore oil production platform 11 is shown at the surface 13 of the sea. Platform 11 is shown as a floating platform, but is merely meant to be representative for any offshore oil platform known in the art, such as jack-up or tension leg platforms. Risers 15 extend from platform 11 to subsea wellheads 17. Wellheads 17 are located at the sea floor 19. Wellheads 17 are positioned above, and in fluid communication with, a string of production tubing 21. Tubing 21 typically extends axially through a series of casing 22 extending below sea floor 19 at least to a depth such that casing is positioned within a reservoir formation 23 having hydrocarbons therein. Perforations 25 extend through casing 22 so that production tubing 21 is in fluid communication with reservoir 23.

A production flowline 27 extends from platform 11 toward sea floor 19. Flowline 27 connects to a pipeline terminal 29 positioned on sea floor 19. Pipeline terminal 29 is in fluid communication with a pipeline 31.

Hydrocarbons from reservoir 23 enter casing 22 through perforations 25 and flow up tubing 21 to subsea wellhead 17 at sea floor 19. Hydrocarbons then flow up riser 15 to platform 11. Typically, the hydrocarbons go through initial processing, such as separating gas and liquid, so that the liquid hydrocarbons can then flow down flowline 27 for delivery into pipeline 31. Typically, pipeline 31 is flowing at a predetermined pressure. Therefore, a pump is usually utilized to bring the liquid hydrocarbons to a sufficient pressure for entering pipeline 31.

Figure 2:
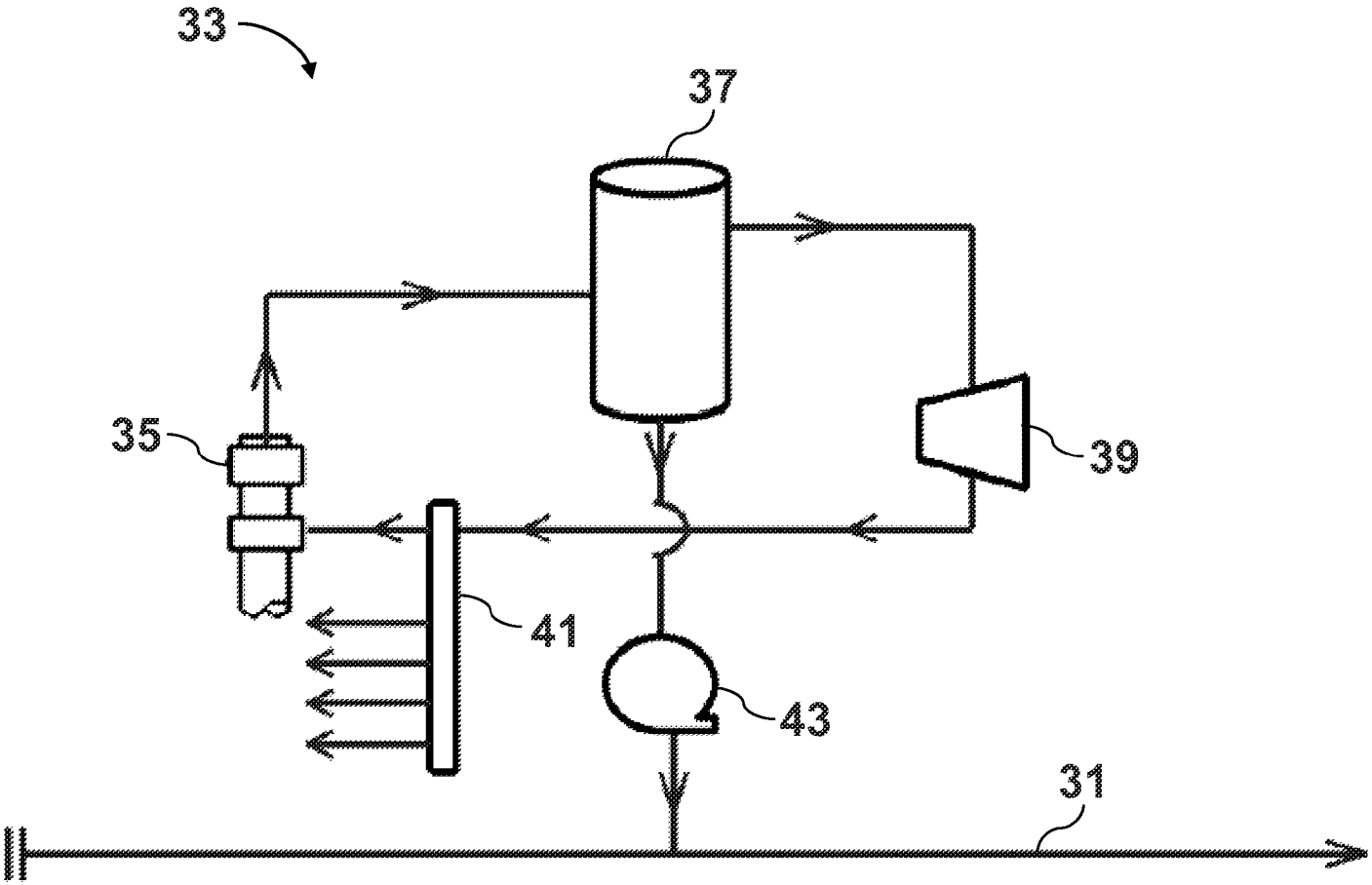
FIG. 2 is a schematic illustration of a well unloading unit and compressor system, in accordance with an embodiment of the present invention.

Referring to FIG. 2, a well unloading unit and compressor system 33 comprises a production tree 35. Production tree 35 can be conventional surface production tree that is located on platform 11 and receives the produced hydrocarbons from riser 15. As will be readily appreciated by those skilled in the art, typically, there are a plurality of production trees 35 that are each associated with a riser 15 and subsea wellhead 17. System 33 also includes an unloading unit 37 positioned on platform 11. Unloading unit 37 receives fluids from production tree 35 and separates the liquid and gas fluids. In an embodiment of the invention, the produced fluids from production tree 35 enter unloading unit 37 at less than 50 psi. Unloading unit 37 can include a static separator, such as a vessel, which lets the gas and liquid phases separate over time. In a preferred embodiment, a three-phase separator is used such that produced water is also separated from the produced fluids. Alternatively, unloading unit 37 can also be a kinetic separator that uses centrifugal forces to help separate the gas and liquid fluids. Such a kinetic separator can be a gas-liquid cylindrical cyclone (GLCC), which is passive in that it does not require any moving parts or motors to create the centrifugal forces.

A compressor 39 in fluid communication with unloading unit 37 receives gas fluids from unloading unit 37. Compressor 39 compresses the produced gases to a predetermined pressure so that the gases can be re-injected into the well to help lift the hydrocarbons from reservoir formation 23 (FIG. 1) to production tree 35. A gas manifold 41 receives the compressed gas from compressor 39 and distributes the gas to each production tree 35 corresponding with subsea wellheads 17. In an embodiment of the invention, the compressed gas flows down the annulus between production tubing 21 and casing 22 for delivery in the well near the depth of reservoir formation 23. As can be readily appreciated by one skilled in the art, gas can also be delivered through dual tubing or concentric tubing extending into the well, wherein a portion of the tubing delivers gas while another portion receives the produced hydrocarbons.

System 33 includes a pump 43 that can be positioned on platform 11. Pump 43 receives liquids from unloading unit 37 and increases the fluid pressure of the liquids. The liquids are then communicated to pipeline 31.

Figure 3:
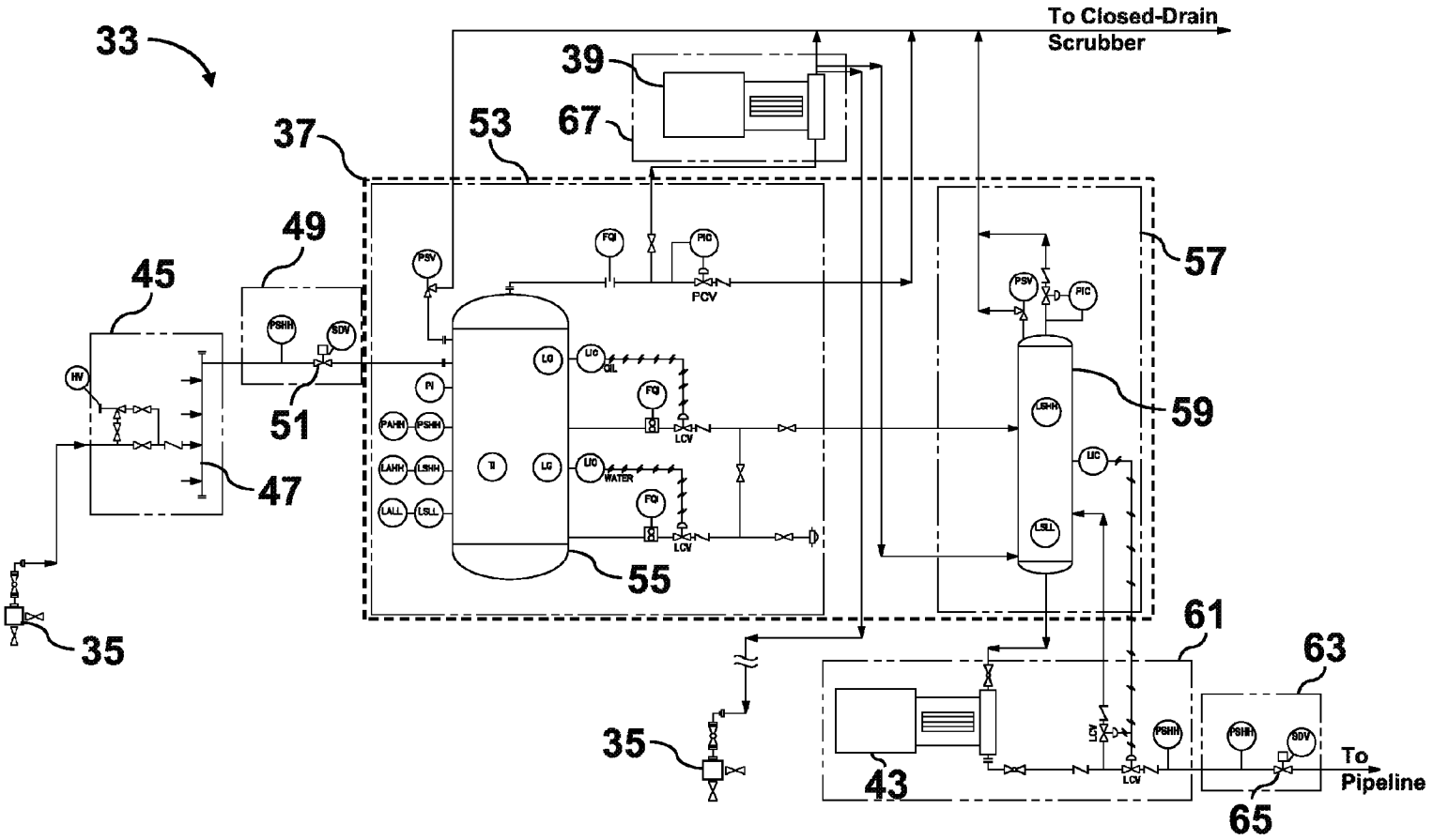
FIG. 3 is a schematic process and flow diagram of a well unloading and compressor system, in accordance with an embodiment of the present invention.

Referring to FIG. 3, system 33 is illustrated showing the process flow of an embodiment of system 33 in more detail. A manifold skid assembly 45 includes a production manifold 47. Production manifold 47 is in fluid communication with a plurality of production trees 35. Production manifold 47 collects the produced fluids from each of the plurality of production trees 35 prior to separation. Manifold skid assembly 45 preferably has production manifold 47 mounted to a skid with piping inlets, controls and valves already assembled. Therefore, when manifold skid assembly 45 is installed, all that is necessary once the skid is in place, is to align piping from production trees 35 with the piping inlets associated with manifold skid assembly 45.

In an embodiment of the invention, a shut down skid assembly 49 is positioned downstream of manifold skid assembly 45. Shut down skid assembly 49 preferably includes a shut down valve assembly 51 for controlling fluid flow from production manifold 47. Shut down skid assembly 49 preferably includes shut down valve assembly 51 and associated inlet and outlet piping mounted to a common skid. Therefore, when shut down skid assembly 49 is in place, all that is needed is to install and align piping from one skid assembly to another, such as between the outlet piping from manifold skid assembly 45 with the inlet piping of shut down skid assembly 49. In a preferred embodiment, shut down valve assembly 51 can be remotely activated in case of an emergency.

System 33 also includes a separator skid assembly 53 having a separator 55 mounted thereon, and a liquid surge skid assembly 57 having a liquid surge tank 59 mounted thereon. In the embodiment shown in FIG. 3, unloading unit 37 comprises separator skid and liquid surge skid assemblies 53,57. Separator skid assembly 53 is positioned downstream of manifold skid assembly 45. Separator skid assembly 53 is preferably also positioned downstream of shut down skid assembly 49 so that shut down valve assembly 51 can control fluid flow prior to it being received by separator skid assembly 53. Separator 55 can be a static or kinetic separator as discussed above herein. Separator skid assembly 53 preferably includes separator, piping, valves and controls mounted to a common skid, so that connecting of piping inlets and outlets is all that is required once separator skid assembly 53 is positioned in place on platform 11.

In a preferred embodiment, separator 55 is a three-phase separator having gas, water and oil outlets. After separation, water is conveyed from separator skid assembly 53 for treatment or further production utilization, if water flooding is being performed. The oil liquids are conveyed from separator skid assembly 53 to liquid surge tank 59 of liquid surge skid assembly 57. Liquid surge tank 59 is typically a vessel. Collecting the oil liquids in liquid surge tank 59 provides a way to help maintain a constant flow rate and pressure of the oil to be pumped to pipeline 31 (FIGS. 1 &2). Additionally, liquid surge tank 59 can act as a second stage separator to further separate gaseous particles from the oil liquids received from separator 55. Liquid surge tank skid assembly 57, which includes liquid surge tank 59, associated piping inlets and outlets, valves and controls, are preferably pre-mounted on a common skid so that connecting of piping inlets and outlets is all that is required once liquid surge tank skid assembly 57 is positioned on platform 11.

System 33 includes a pump skid assembly 61 having pump 43 mounted thereon. Pump 43 is preferably a positive displacement pump, such as a reciprocal pump. Pump 43 increases the pressure of the liquid from separator 55 and liquid surge tank 59 so that it can enter pipeline 31 (FIGS. 1&2) at the predetermined pressure for the pipeline 31. Pump skid assembly 61 preferably includes pump 43, an engine or motor, associated inlet and outlet piping, valves and controls pre-mounted on a common skid so that connecting of piping inlets and outlets and fuel or power supply is minimal once in position on platform 11. In an embodiment of the invention, an additional shutdown skid assembly 63 having shut down valve 65 is positioned downstream of pump skid assembly 61 so that flow to pipeline 31 can be controlled in case of an emergency. In a preferred embodiment, shut down valve 65 can also be a remote-actuated valve.

A compressor skid assembly 67 is also positioned downstream of separator skid assembly 53. Compressor 39 is mounted on the skid of compressor skid assembly 67. Compressor 39 is a compressor capable of compressing the separated gas from an inlet pressure of less than 50 psi to approximately 1100-1200 psi, which is then sent to gas manifold 41 (FIG. 2) for distribution to the production wells for gas lifting. In a preferred embodiment, compressor 39 can handle 2 million standard cubic feet per day (MMSCF/D), which is suitable for gas lifting four or five wells. Additional compression stages, or an additional compressor skid assembly can be utilized when gas lifting more than five wells.

In a preferred embodiment compressor 39 is a three stage reciprocating compressor assembly. Compressor assembly includes suction scrubbers or de-liquifiers to remove remaining liquid entrained in the gas after each stage of compression, a gas engine and fin-fan motor driven coolers to reduce temperature of compressed gas after each stage of compression. A separate fuel gas skid can be utilized to supply fuel to the gas engine. Liquids from the scrubbers can be conveyed from compressor skid assembly 67 to liquid surge tank 59. Compressor skid assembly 67 preferably includes compressor 39 with its associated equipment, piping, valves and controls pre-mounted on a common skid so that minimal installation work is necessary after the compressor skid assembly 67 is in place on platform 11. Excess gas from compressor 39 can be diverted to a closed-drain scrubber, which can also receive the gas separated from separator 55 and liquid surge tank 59.

As discussed in the Background, one problem associated with conventional well unloading units or processes is that the produced gas that is separated is vented to the atmosphere and lost. System 33 advantageously solves this problem by collecting the produced gas after separation for re-injection into the well for gas lifting application.

System 33 combines two key forms of artificial lift—1) reduction of backpressure at the surface and 2) gas lift to increase production rates and reserves from underground oil reservoirs. System 33 allows wells to be gas lifted while simultaneously flowing to a very low surface pressure (<30 psi) because unloading unit 37 and pump 43 prevent the buildup of backpressure on production trees 35. Unloading unit 37 also provides the gas utilized for the gas lift. System 33 has the additional benefit of capturing what would otherwise be vented hydrocarbons, and thus reducing greenhouse gas emissions and utilizing it for artificial lift.

Additionally, the wells can be both producing production fluid to unloading unit 37 and gas lifted at the same time because the injected gas is injected through the annulus between tubing 21 and casing 22 or through a dual string of tubing. This creates a closed loop gas lift system and the gas is re-used for lifting, making it fully optimized to maximize production. No conventional artificial lift systems have accomplished this closed loop gas lift, while reducing the backpressure at the surface. Moreover, no other conventional artificial lift system does this while also capturing the otherwise vented gaseous produced fluids.

Another advantageous aspect of system 33 is its mobility. System 33 includes manifold skid assembly 45, unloading unit 37 with separator skid and liquid surge tank skid assemblies 53,57, pump skid assembly 61 and compressor skid assembly 67. Because each of these components can include pre-mounted and installed equipment and piping, system 33 is modular and can be rigged up or down in a single 12 hour shift offshore. Such mobility enables system 33 to service multiple platforms for maximum usage. System 33 also requires much less capital investment as compared to standard gas lift operations which require the upfront cost of a gas lift compressor on each platform. When system 33 has extracted suitable reserves from a first platform 11 and it is no longer economical to keep the system running, system 33 can be rigged down and mobilized to another platform 11 to continue operation because of its modular nature.

Such mobility and flexibility to service multiple platforms is not known to exist for any other systems, which also provides a unique opportunity to effectively and economically extract reserves that would otherwise not be produced after the well productivity declines.

Another aspect is that system 33 has a small space requirement or "footprint" on an offshore platform deck as compared with conventional gas lift assemblies. Having such a small footprint further allows well work operations, such as slick line and electric line operations, to take place simultaneously with system 33. This is advantageous in several offshore environments where frequent well interventions are required.

While the invention has been shown in only some of its forms, it should be apparent to those skilled in the art that it is not so limited, but susceptible to various changes without departing from the scope of the invention. For example, the compressor skid assembly 67 could also receive the separated gas from liquid surge tank 59 for compression and re-injection into the wells.

What is claimed:

1. An offshore platform skid mounted removable well unloading unit and compressor system for producing hydrocarbons from a well in fluid communication with a reservoir formation, the system comprising:

an offshore platform unloading unit comprising skid mounted units configured to receive a produced fluid having hydrocarbons, said hydrocarbons enter the unloading unit at less than 50 psi, from the well via a production tree and separate the produced fluid into a liquid fluid and a gas fluid, and wherein the unloading unit comprises a three-phase separator configured to separate water from the produced fluid, the unloading unit includes a kinetic separator;

a compressor in fluid communication with the unloading unit and configured to receive the gas fluid from the unloading unit and compress the gas fluid to a predetermined pressure of 1100-1200 psi from an inlet pressure of less than 50 psi so that the gas fluid can be re-injected into the well and not vented into the environment to help lift the produced fluid from the reservoir formation to the production tree, and the unloading unit, compressor, gas manifold, and pump are disposed on one or more skids, for offshore platform well unloading such that each skid can be transported from a platform and re-used for producing hydrocarbons from different reservoir formations on a different platform as the well unloading;

the gas manifold is configured to receive the compressed gas fluid at a pressure of 1100-1200 psi from the compressor and distribute the gas fluid to at least one production tree and at least one corresponding well;

the pump is configured to receive the liquid fluids from the unloading unit, increase the fluid pressure of the liquid fluid, and deliver the liquid fluid to a pipeline and the pump is configured to deliver the liquid fluid to the pipeline, the pipeline being located on a seafloor and the unloading unit, compressor, and gas manifold are configured to operate as a substantially closed gas lift system, such that the unloading unit receives the gas fluid previously injected into the well; and a shutdown assembly downstream of a manifold assembly and upstream of the unloading unit; and a shutdown assembly downstream of the pump assembly.

2. A method for producing hydrocarbons in an offshore location from an offshore platform from an underwater well in fluid communication with a reservoir formation and the surface platform, the method comprising:

receiving in an offshore platform unloading unit a comprising skid mounted units to produced fluid having an initial pressure of less than 50 psi from the well and separating the produced fluid into a liquid fluid and a gas fluid, and wherein the step of receiving and separating the produced fluid comprises separating water from the gas and liquid fluids and includes kinetically separating the produced fluid, and the step of receiving the produced fluid comprises receiving gas fluid previously injected into the well such that the gas fluid is re-used in a substantially closed gas lift cycle and not vented into the environment and wherein the steps of receiving the produced fluid and increasing the pressure of the liquid fluid comprises reducing backpressure at the well;

compressing the gas fluid from the unloading unit to a predetermined pressure of 1100-1200 psi from an initial pressure of less than 50 psi; distributing the gas fluid to at least one production tree and corresponding well; re-injecting the gas fluid into the well to help lift the produced fluid from the reservoir, the step of re-injecting the gas fluid is performed while the unloading unit is receiving the produced fluid from the well such that the well is producing while being subjected to a gas lift operation;

increasing the fluid pressure of the liquid fluid in a pump and delivering the liquid fluid to a pipeline, and the delivering step comprises delivering the liquid fluid to the pipeline, the pipeline being located on a seafloor further comprising;

providing on one or more skids for offshore platform assembly for the unloading unit, a compressor for performing the compressing step, a gas manifold for performing the distributing step, and the pump, wherein the units unload the produced fluids, separate the fluid gas for reinjection and permit the liquid fluids to flow to the pipeline;

transporting each skid from a location proximate the reservoir formation on a platform above the reservoir formation after depletion of liquid fluid to a location proximate a second reservoir formation on a platform above the second reservoir and re-using the unloading unit, the compressor, the gas manifold, and the pump for producing hydrocarbons from the second reservoir formation;

a means for shutting down the hydrocarbons produced from a manifold; and a means for shutting down the flow of the liquid to the pipeline.

* * * * *